US007048558B2

(12) United States Patent
Fan

(10) Patent No.: US 7,048,558 B2
(45) Date of Patent: May 23, 2006

(54) MEMORY CARD CONNECTOR

(75) Inventor: Chia Hao Fan, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/994,051

(22) Filed: Nov. 19, 2004

(65) Prior Publication Data

US 2005/0112924 A1 May 26, 2005

(30) Foreign Application Priority Data

Nov. 25, 2003 (CN) ..... 200320120043

(51) Int. Cl.
*H01R 13/62* (2006.01)
*H01R 13/627* (2006.01)

(52) U.S. Cl. ..... 439/157; 439/350

(58) Field of Classification Search ..... 439/157, 439/350, 352, 361, 367, 607
See application file for complete search history.

(56) References Cited

U.S. PATENT DOCUMENTS

| | | | | |
|---|---|---|---|---|
| 4,653,836 | A * | 3/1987 | Peele | 439/610 |
| 6,227,904 | B1 * | 5/2001 | Wang et al. | 439/541.5 |
| 6,402,529 | B1 | 6/2002 | Saito et al. | |
| 6,609,919 | B1 | 8/2003 | Ito et al. | |
| 6,641,413 | B1 | 11/2003 | Kuroda | |
| 6,890,206 | B1 * | 5/2005 | Distad et al. | 439/372 |
| 2002/0072274 | A1 * | 6/2002 | Flickinger et al. | 439/607 |

* cited by examiner

*Primary Examiner*—Chandrika Prasad
(74) *Attorney, Agent, or Firm*—Wei Te Chung

(57) ABSTRACT

An electrical card connector (100) adapted for accepting memory cards includes an insulative housing (2) defining a card receiving space (24), a number of terminals (5) retained in the housing for electrically connecting with the cards and a metal shell (1) substantially covering the housing. The housing includes a bottom wall (21) and a pair of sidewalls (22, 23) upwardly extending from the bottom wall. Each sidewall provides at least one elastic flap (221, 231) having an outwardly projecting locking portion (2211, 2311). The flap is movable in lateral directions under an external force. The shell includes a pair of side plates (12) each defining at least one locking hole (121) engaging with the locking portion of the at least one flap of the housing.

12 Claims, 12 Drawing Sheets

MEMORY CARD CONNECTOR

CROSS-REFERENCE TO RELATED APPLICATIONS

This application is related to the contemporaneously filed U.S. patent applications entitled "CONNECTOR FOR MEMORY CARDS", entitled "CONNECTOR FOR MEMORY CARDS", and entitled "MEMORY CARD CONNECTOR", all of which are invented by the same inventor and assigned to the common assignee as the present invention.

BACKGROUND OF THE INVENTION

1. Filed of the Invention

The present invention relates to a card connector which can be mounted on electronic device, and more particularly to a compact card connector having a reliable shell.

2. Description of the Prior Art

Usually, memory cards used for consumptive electronic products, such as digital cameras, MP3 players or the PDAs, mostly can be classified into seven standard memory cards, a multi-media card (MMC), an xD-picture card (XD), a secure digital card (SD), a smart media card (SM), a compact flash card (CF) including type I and type II and the memory stick card (MS). Wherein, the difference between the SD card and the MMC card is the number of contact pins and the thickness so that a common slot socket of the read and write apparatus is enough for both of the cards. Hence, read and write connectors adapted to multiple memory cards have been provided. Such connector usually has a metallic shell for avoiding electromagnetic interference (EMI).

An example of a conventional electronic card connector is disclosed U.S. Pat. No. 6,609,919 B2 issued to Ito. et al. on Aug. 26, 2001. The Ito card connector includes a connector body, a plurality of terminals received in the connector body and a shell covering the connector body. The connector body includes a bottom wall and three rims interconnecting end-to-end and upwardly extending from the respective left, right and rear sides of the bottom wall. Each rim has a plurality of protrusions projecting outwardly. The shell defines a plurality of locking holes engaging with the protrusions to secure the shell to the housing.

However, when the Ito shell is bend to cover the connector body, the curving portion of the shell is elastic and is easy to rebound. Thus, the protrusions of the connector body are potentially falling out of the locking holes. Therefore, the engagement between the connector body and the shell is unreliable.

Hence, an improved card connector with reliable shell is desired to overcome the above-mentioned shortcomings.

BRIEF SUMMARY OF THE INVENTION

A main object of the present invention is to provide a compact card connector capable of reliably containing multiple cards therein.

Another object of the present invention is to provide a compact and simple connector can be easily manufactured, and soldering work, servicing work and the like can be conveniently carried out.

A further object of the present invention is to provide a card connector which is robust and durable.

In order to achieve the objects mentioned above and others, one embodiment of an electrical card connector adapted for accepting memory cards includes an insulative housing defining a card receiving space, a plurality of terminals retained in the housing for electrically connecting with the cards and a metal shell substantially covering the housing. The housing includes a bottom wall and a pair of sidewalls upwardly extending from the bottom wall. Each sidewall provides at least one elastic flap having an outwardly projecting locking portion. The flap is movable in lateral directions under an external force. The shell includes a pair of side plates each defining at least one locking hole engaging with the locking portion of the at least one flap of the housing.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE INVENTION

Figure 1:
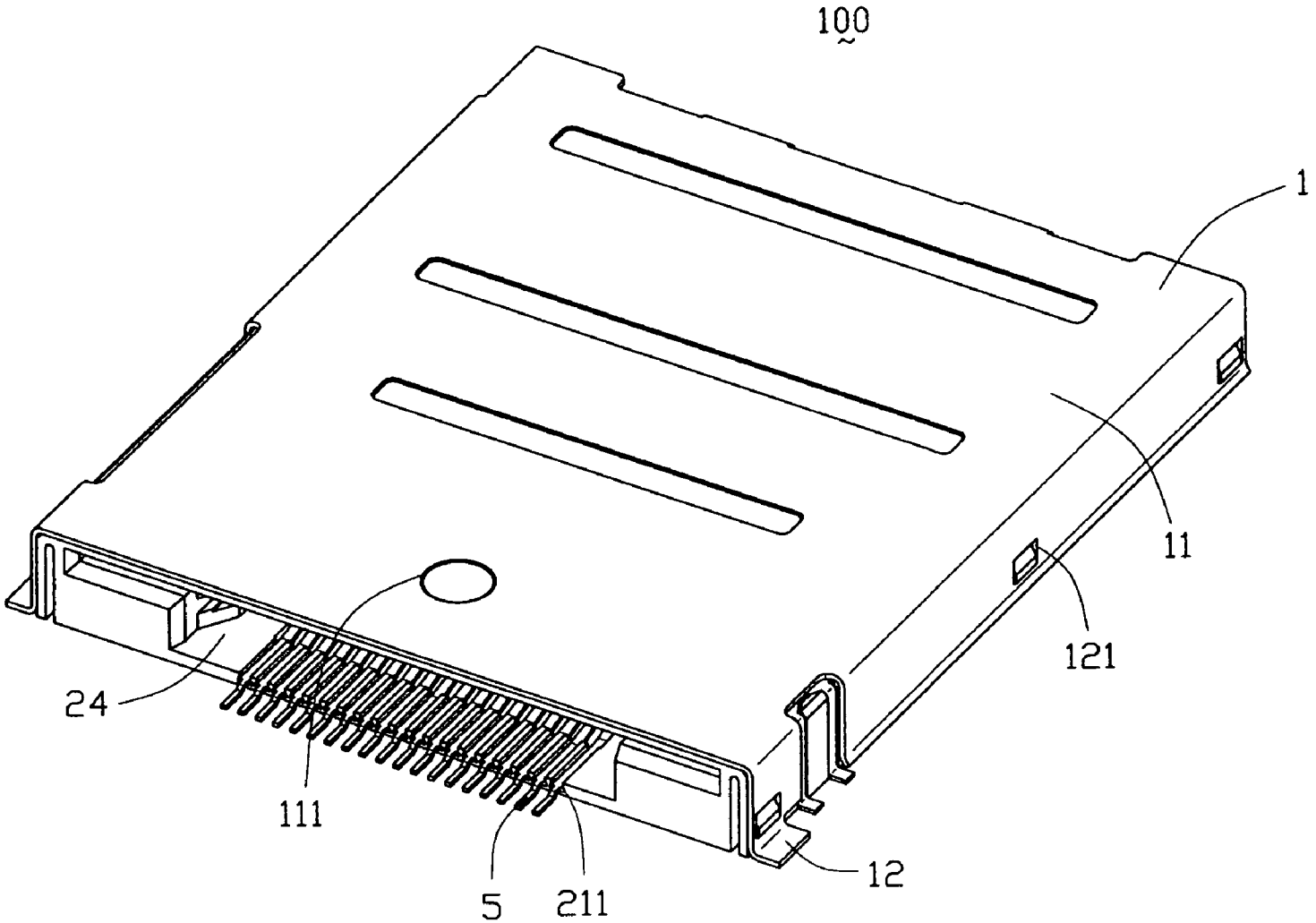
FIG. 1 is a perspective view of an electrical card connector in accordance with the present invention.

The present invention will now be described with reference to drawings, and first to FIGS. 1 and 6. An electrical card connector 100 according to the present invention for mounting on a PCB (not shown) is of generally rectangular shape and comprises an insulative housing 2, an outer shell 1 covering the housing 2, a terminal module 3 embedded in the housing 2 and a positioning member 4. A plurality of terminals, designated numeral 5, are disposed in the housing 1 of the card connector 100. In the preferred embodiment, such terminals 5 are provided for mating with an xD-picture card (XD). For convenience, such terminals are referred to hereafter as XD terminals 5. The card connector further includes a grounding contact 6, a pair of switch contacts 7, a written contact 8 and a pair of written protection contacts 9. The structure and the function of the grounding contact 6, the switch contacts 7, the written contact 8 and the written protection contacts 9 are well known to those skilled in the art, a detailed description is omitted herein.

Figure 5:
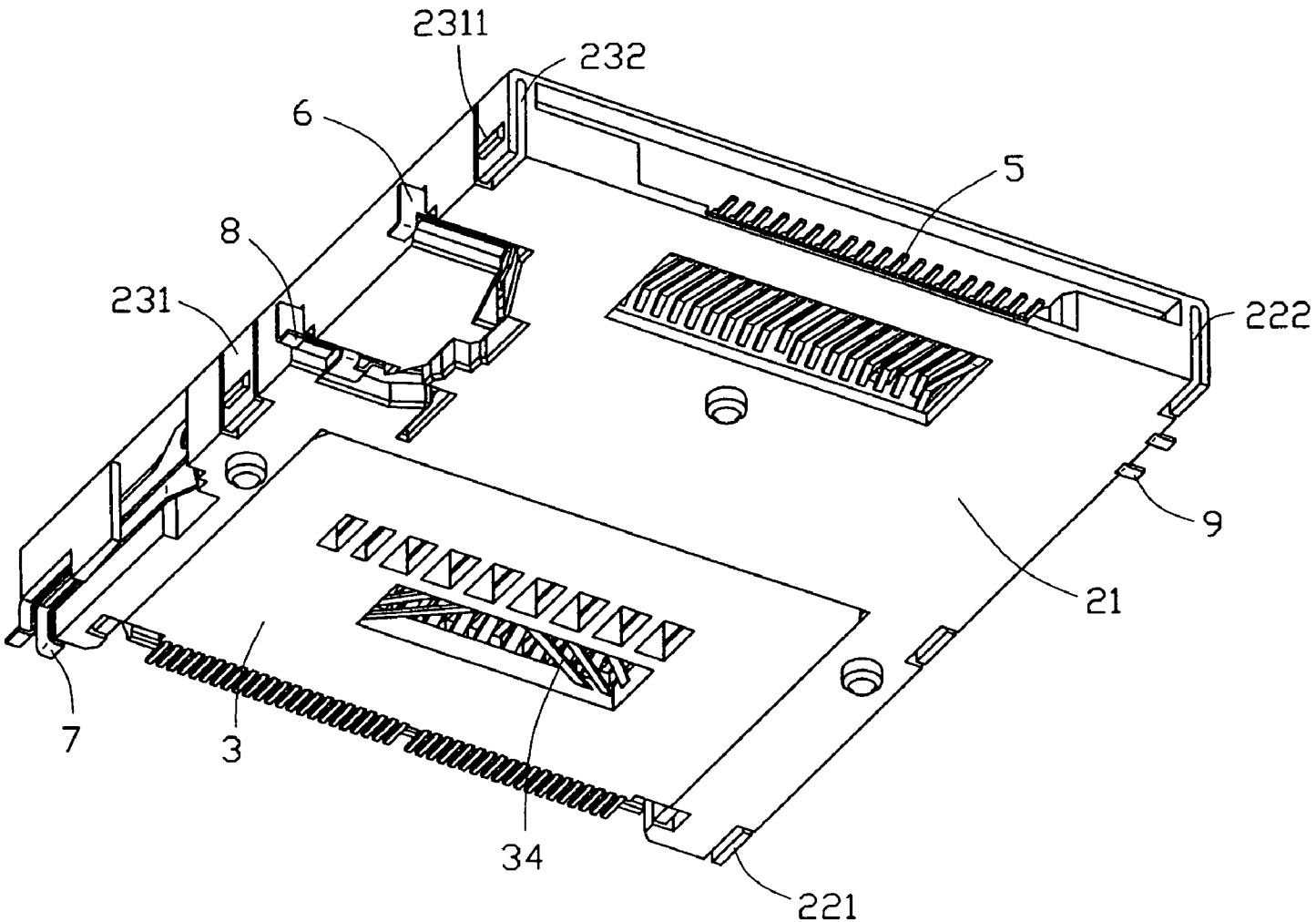
FIG. 5 is another perspective view of FIG. 3, taken from a bottom aspect.
Figure 6:
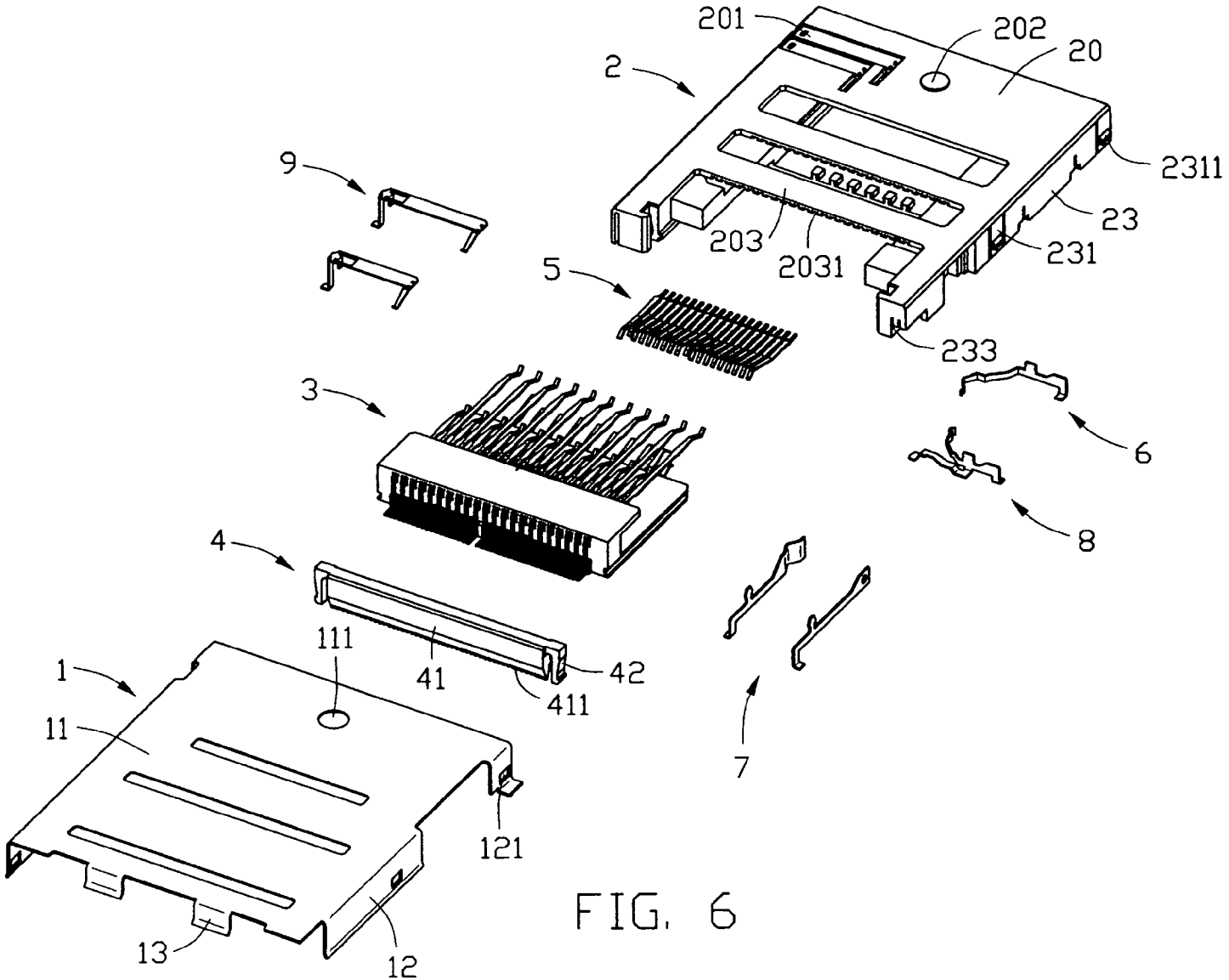
FIG. 6 is an exploded view of FIG. 1.
Figure 7:
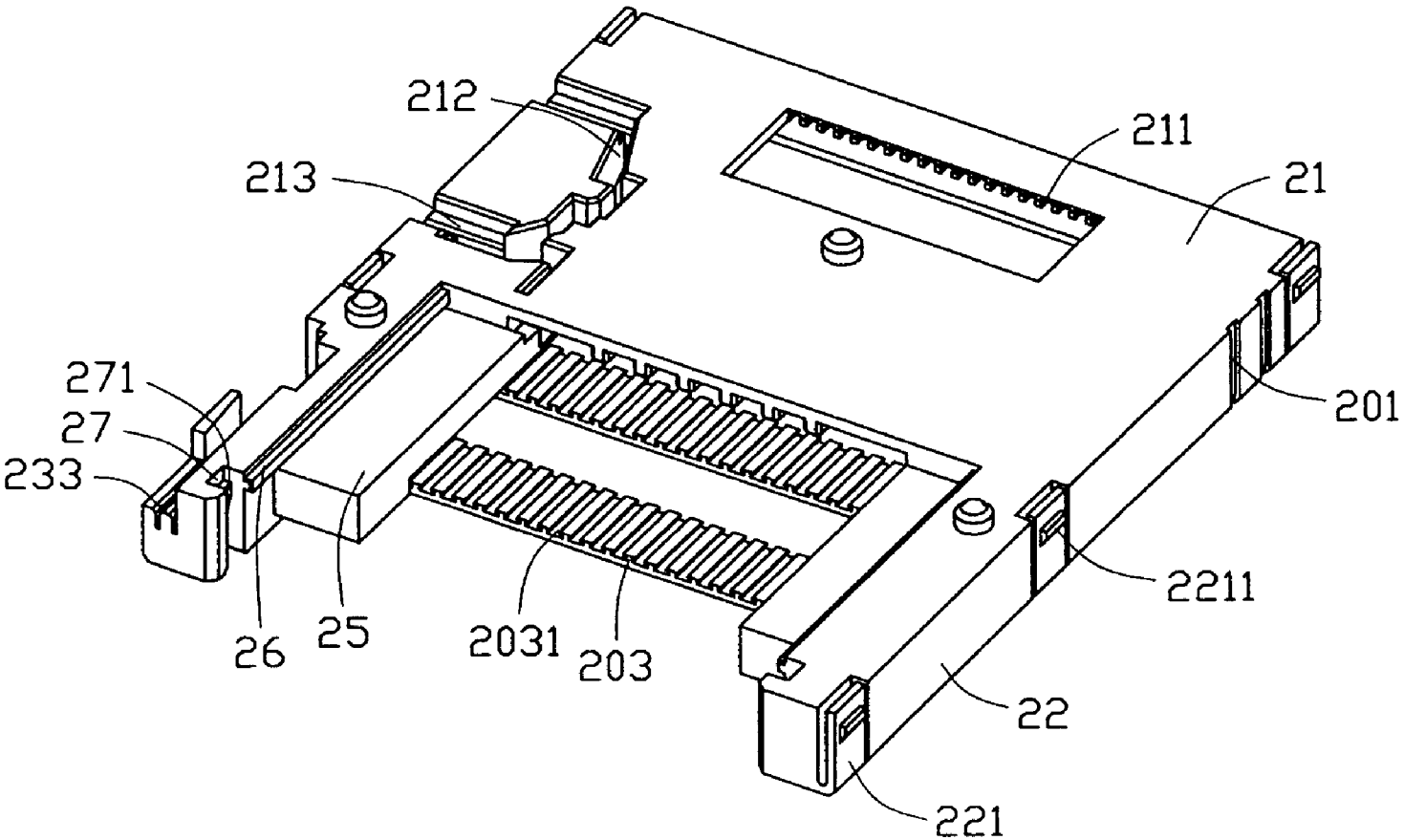
FIG. 7 is a perspective view of an insulative housing shown in FIG. 6, taken from bottom aspect.

Referring to FIGS. 3–7, the housing 2 comprises an upper wall 20, a bottom wall 21 and a pair of left and right sidewalls 22, 23 connecting the upper wall 20 to the bottom wall 21 thereby forming a card receiving space 24 therebetween for receiving multiple memory cards (not shown). The upper wall 20 includes a pair of written protection contact mounting recesses 201 in a front portion thereof for receiving the written protection contacts 9 and a protrusion 202 projecting upwardly from a front middle portion thereof for latching with the outer shell 1. A plurality of spaced longitudinal cutouts (not labeled) are defined in a rear portion of the upper wall 20 thereby forming a plurality of parallel crossrails 203 between adjacent two cutouts. A row of slots 2031, as best shown in FIG. 7, are defined in an inner side surface of the crossrails 203 and communicate with the card receiving space 24. A plurality of passages 211 are spaced along an inner side surface of the bottom wall 21 and communicate with the card receiving space 24. The bottom wall 21 further defines a grounding contact mounting recess 212 and a written contact mounting recess 213 adjacent to the right sidewall 23 of the housing 2. The grounding contact mounting recess 212 and the written contact mounting recess 213 communicate with each other and respectively for receiving the grounding contact 6 and the written contact 9. The left and right sidewalls 22, 23 respectively have a plurality of cantilevered flaps 221, 231. The flaps 221, 231 respectively extending downwardly from outer edges of the left and right sidewalls 22, 23 and are essentially parallel to and laterally offset from the left and right sidewalls 22, 23, thereby forming a plurality of gaps 222, 232, specially shown in FIG. 4, between inner side surfaces of corresponding flaps and outer surfaces of the left and right sidewalls 22, 23. Each flap 221, 231 forms a locking portion 2211, 2311 projecting outwardly therefrom for engaging with the outer shell 1. Each locking portion 2211, 2311 has a trapeziform cross-section. A top surface of the locking portion 2211, 2311 is an inclined surface acting as a lead-in surface during the outer shell 1 being attached to the housing 2, and a bottom surface of the locking portion 2211, 2311 is perpendicular to outer side surface of the flap 221, 231. The right sidewall 23 further defines a pair of switch contact mounting recesses 233 in a lower rear portion for receiving the switch contacts 7 therein. A pair of guiding columns 25 are formed on opposite sides of the bottom wall 21 along the left and right sidewalls 22, 23. A pair of ribs 26 respectively project inwardly from inner side surfaces of the left and right sidewalls 22, 23. The ribs 26 are dimensioned and positioned under the columns 25 for engaging with the terminal module 3, which will be discussed more detailed hereinafter. A pair of grooves 27 are defined on a rear portion of opposite sidewalls 22, 23 and communicate with the card receiving space 24. Each groove 27 forms an embossment 271 for engaging with the positioning member 4, as will be more fully discussed.

Figure 2:
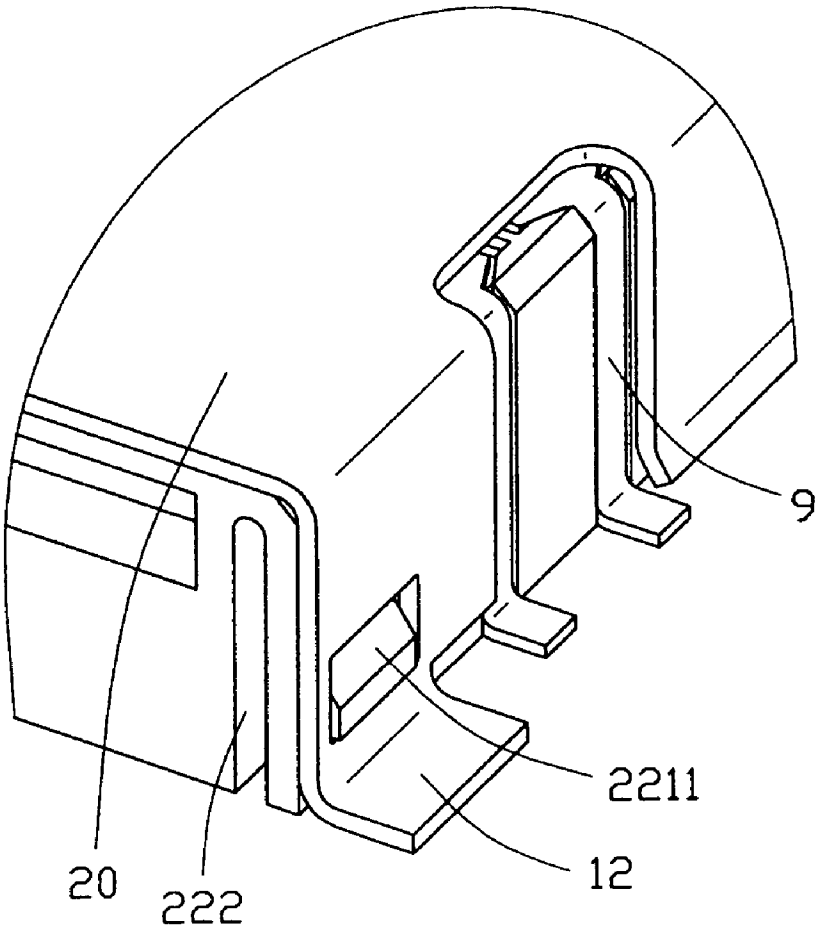
FIG. 2 is a partially enlarged view of FIG. 1, specially showing a side plate of the outer shell engaging with the sidewall of the insulative housing.

Referring to FIGS. 1, 2 and 6, the outer shell 1 is formed with a metal sheet and provided for covering the housing 2. The shell 1 includes a top plate 11, a pair of side plates 12 extending downwardly from opposite sides of the top plate 11 and a rear plate 13 extending downwardly from a rear end of the top plate. The top plate 11 defines an aperture 111 for engaging with the protrusion 202 of the housing 2. Each side plate 12 defines a plurality of locking holes 121 for engaging with the locking portions 2211, 2311 of the housing 2.

Referring to FIGS. 8–12, the terminal module 3 includes an insulative casing 31 and a plurality of first, second, and third conductive terminals 32, 33, 34 received in the insulative casing 31. In the preferred embodiment, the first and second terminals 32, 33 are respectively provided for mating with a Smart Media Card (SM) and a Memory Stick Card (MS). The third terminals 34 are provided for mating with a secure digital card (SD) or a multi-media card (MMC). For convenience, such first, second and third terminals 32, 33, 34 are respectively referred to hereafter as SM terminals 32, MS terminals 33 and SD terminals 34.

Figure 8:
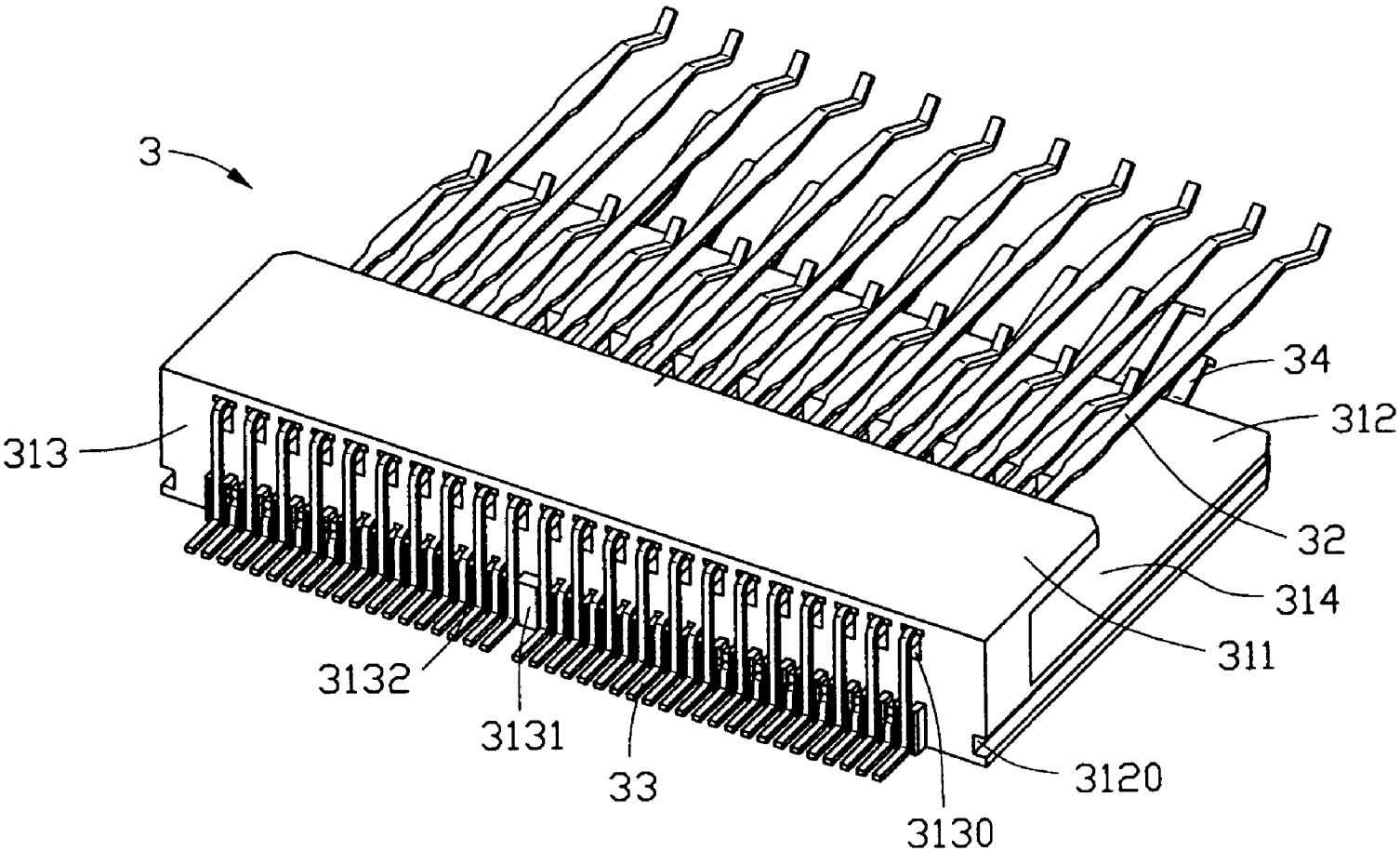
FIG. 8 is a perspective view of a terminal module shown in FIG. 6.
Figure 10:
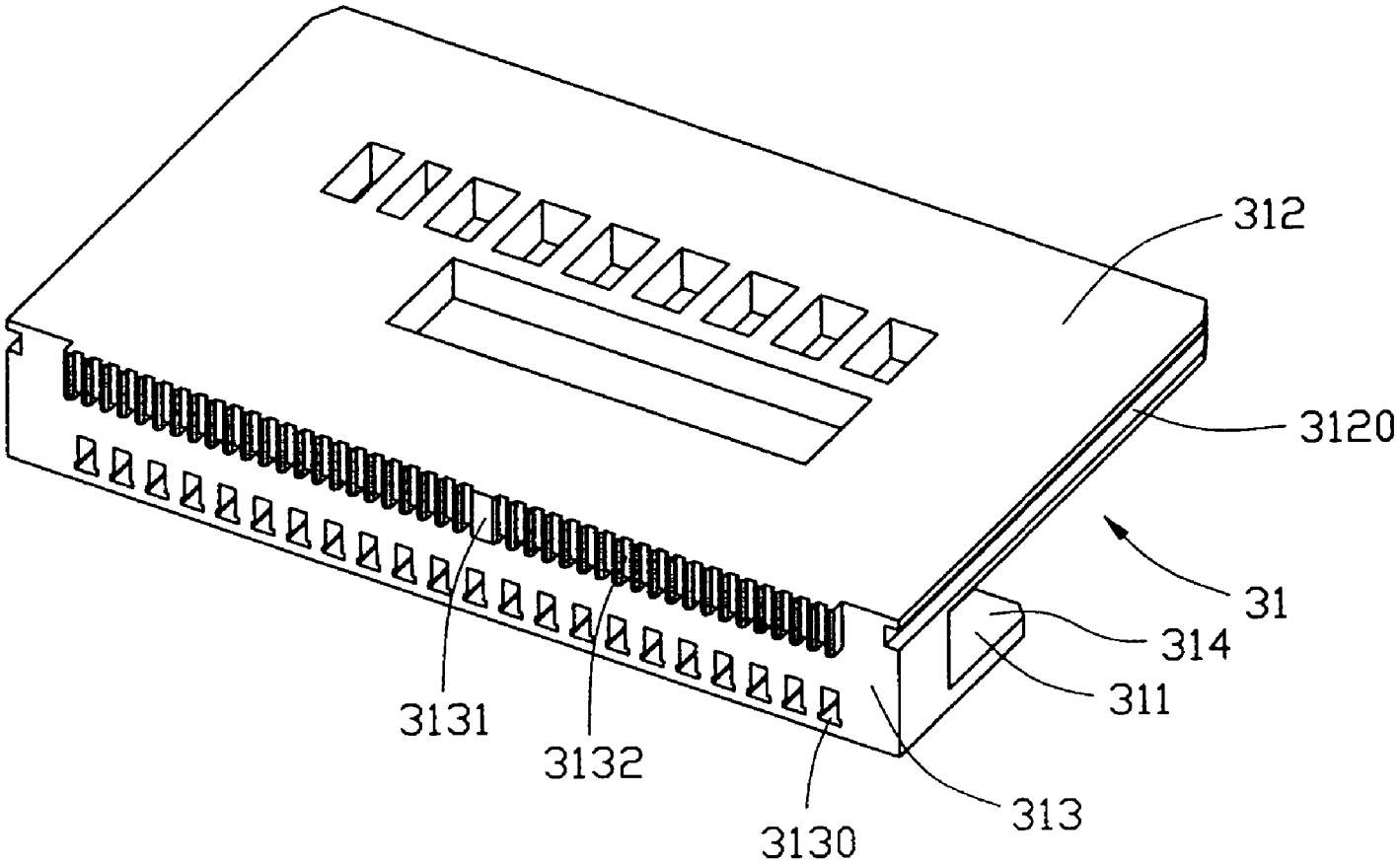
FIG. 10 is a perspective view of an insulative casing of the terminal module shown in FIG. 9.

As best shown in FIG. 10 in conjunction with FIG. 8, the insulative casing 31 comprises a first horizontal plate 311, a second horizontal plate 312 and a vertical plate 313 connecting rear portions of the first and the second horizontal plates 311, 312 to define a insertion space 314. The second horizontal plate 312 is essentially twice as length as the first horizontal plate 311. A pair of guiding rabbets 3120 are defined in opposite sides of the second horizontal plate 312 for engaging with the ribs 26 of the housing 2. The vertical plate 313 defines a plurality of T-shaped passageways 3130 adjacent to the first horizontal plate 311 and a plurality of comb passages 3132 adjacent to the second horizontal plate 312. A dividing wall 3131 is dimensioned to separate the comb passages 3132 into two portions. The dividing wall 3131 provides multiple functions such as providing polarization for the SM terminals 32 during assembling the terminal module 3, as will be discussed later.

Figure 11:
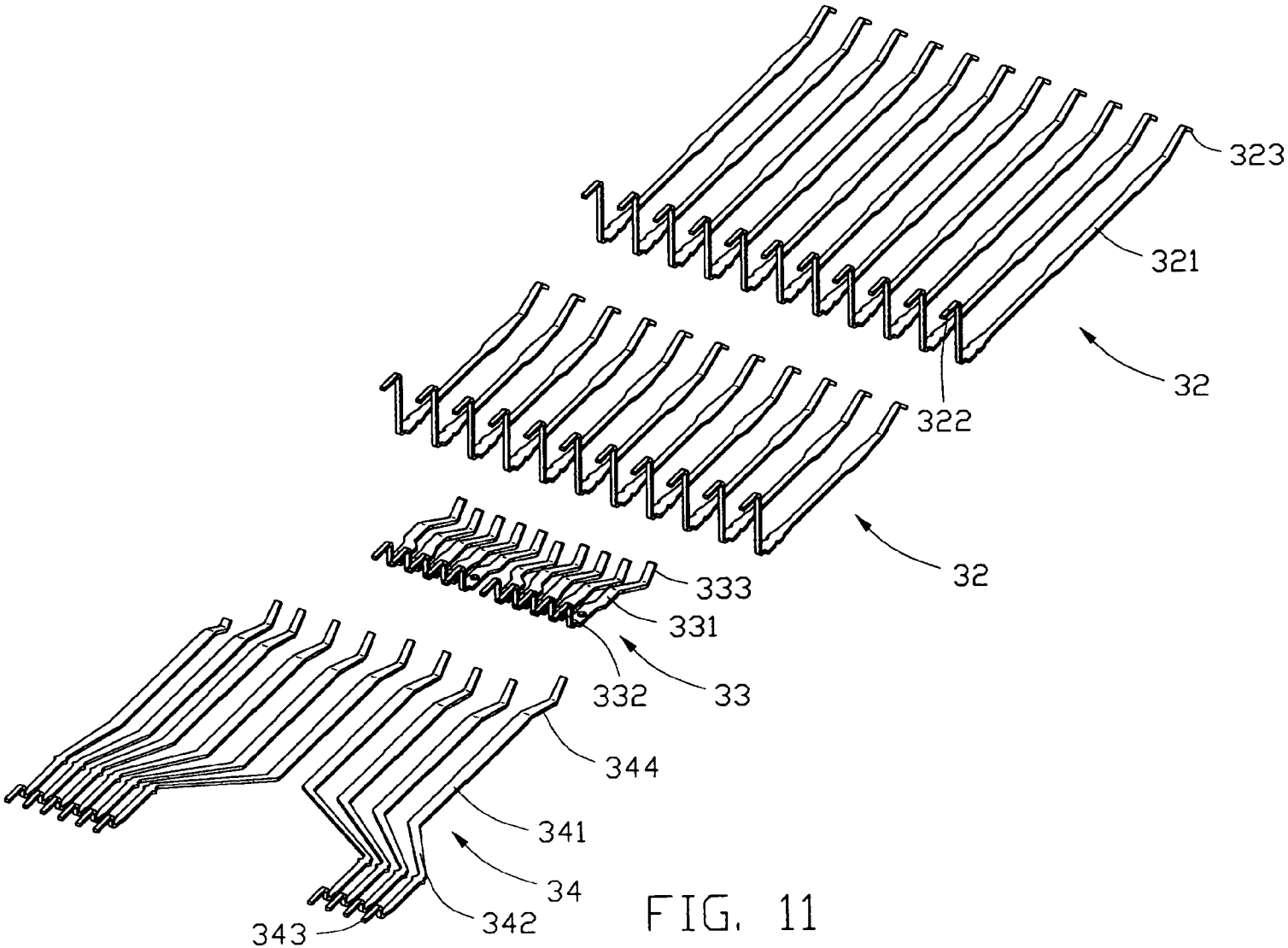
FIG. 11 is an exploded view of a plurality of terminals shown in FIG. 8.
Figure 12:
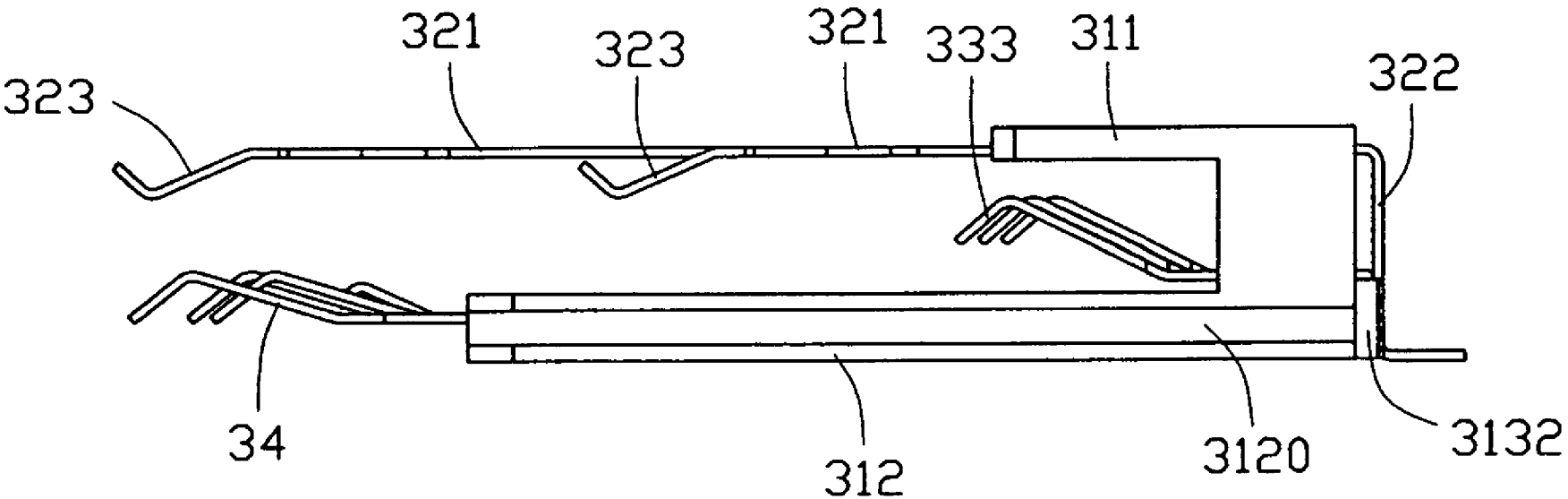
FIG. 12 is a left side elevational view of FIG. 8.

As best shown in FIGS. 10 and 11, the SM terminals 32 comprise two arrays of SM terminals 32. The two arrays of SM terminals 32 are substantially identical in configuration and structure except that they are of different lengths. Each SM terminal 32 includes a middle SM body portion 321, a front V-shaped SM contacting portion 323 for electrically connecting with an SM card, and a rear L-shaped SM mounting portion 322 for being soldered to a circuit board (not shown), on which the electrical card connector is mounted. Each MS terminal 33 comprises a MS body portion 331, a front MS contacting portion 333 for mating with a MS card and a rear L-shaped MS mounting portion 332 for being soldered to the circuit board. Each SD terminal 34 includes a middle SD body portion 341, a front SD contacting portion 344 adapted for a SD card, a rear L-shaped SD mounting portion 343 for being soldered to the circuit boards and a connecting portion 342 connecting the SD mounting portion 343 to the SD body portion 341. In the preferred embodiment, the SD terminals 34 are of ten pieces. Some connecting portions 342 of the SD terminals 34 are bent in a right-to-left direction, and the other pieces are bent in a left-to-right direction. Each L-shaped mounting portion 322, 332, 343 of the SM, MS and SD terminals 32, 33, 34 includes a vertical portion (not labeled) and a horizontal portion (not labeled) extending rearwardly from an end of the vertical portion.

Referring now to FIG. 6, the positioning member 4 is of a generally elongated rectangular configuration and includes a base portion 41 and a pair of positioning arms 42 symmetrically extending downwardly from opposite sides of the base portion 41. The base portion 41 defines a plurality of positioning recesses 411 at a bottom edge thereof for receiving the SM, MS and SD mounting portions 322, 332, 343 of the SM, MS and SD terminals 32, 33, 34. The positioning arms 42 are provided for engaging with the embossments 271 of grooves 27 of the housing 2 to securely position the positioning number 4.

Referring to FIGS. 8–12, in assembly, firstly to assemble the terminal module 3, in the preferred embodiment, the MS terminals 33 and the SD terminals 34 are installed in respective ones of the comb passages 3132 of the casing 31. The MS and SD body portions 331, 341 of the MS and SD terminals 33, 34 are held in the second horizontal plate 312 of casing 31, and the MS and SD contacting portion 333, 344 extend beyond the casing 31. It should be noted that the MS terminals 33 and the SD terminals 34 can also be integrally formed with the casing 31. The SM terminals 32 are inserted into the casing 31 in a rear-to-front direction to form the terminal module 3. The SM body portions 321 of two arrays of SM terminals 32 are alternately spaced along the passageways 3130 of the casing 31, the SM mounting portions 322 are partially received in the passageways 3130 of the casing 31, and the SM contacting portion 323 extend beyond the first horizontal plate 311 and are arranged in two lines.

Figure 3:
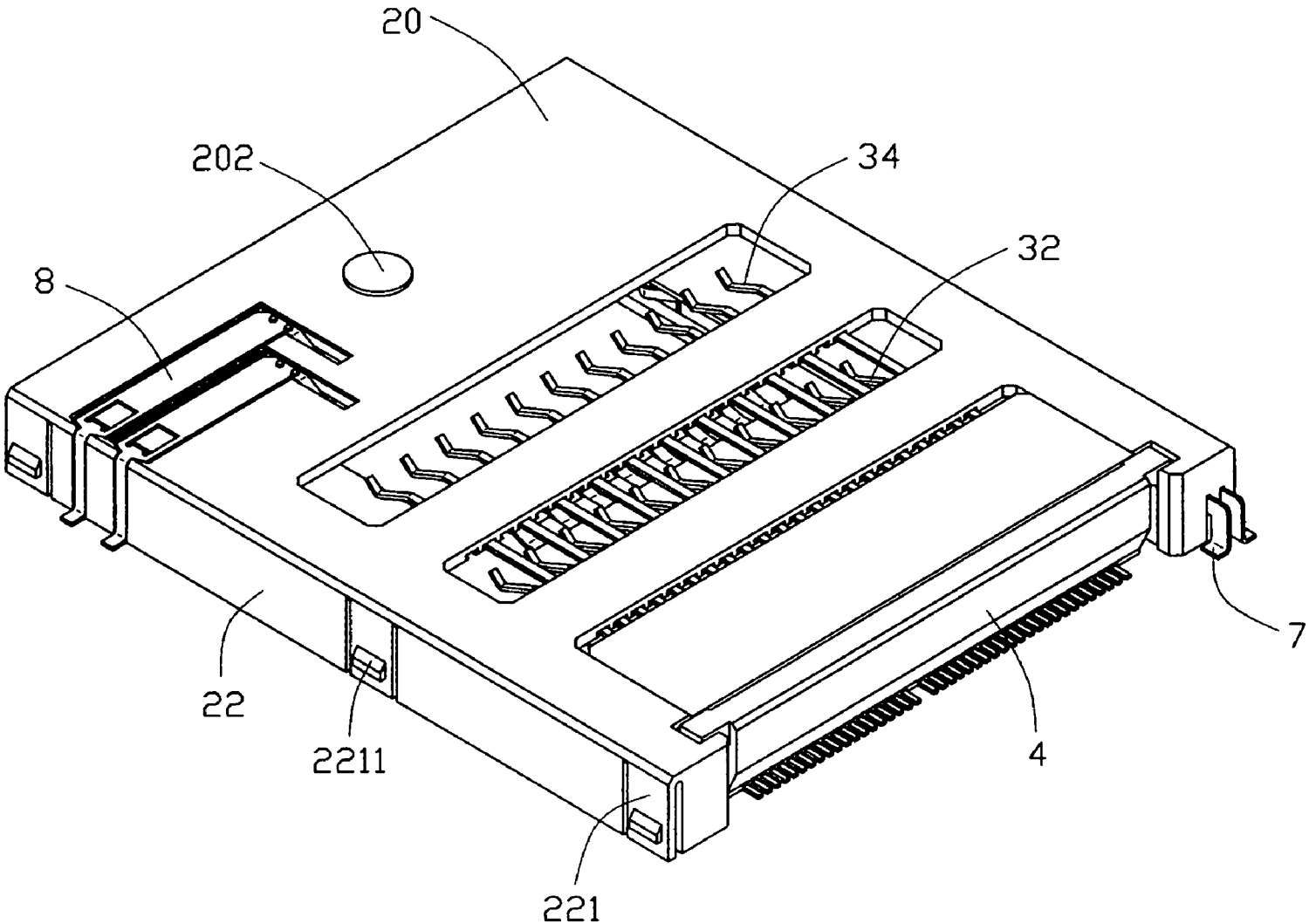
FIG. 3 is another perspective view of the card connector, wherein an outer shell is taken away.
Figure 4:
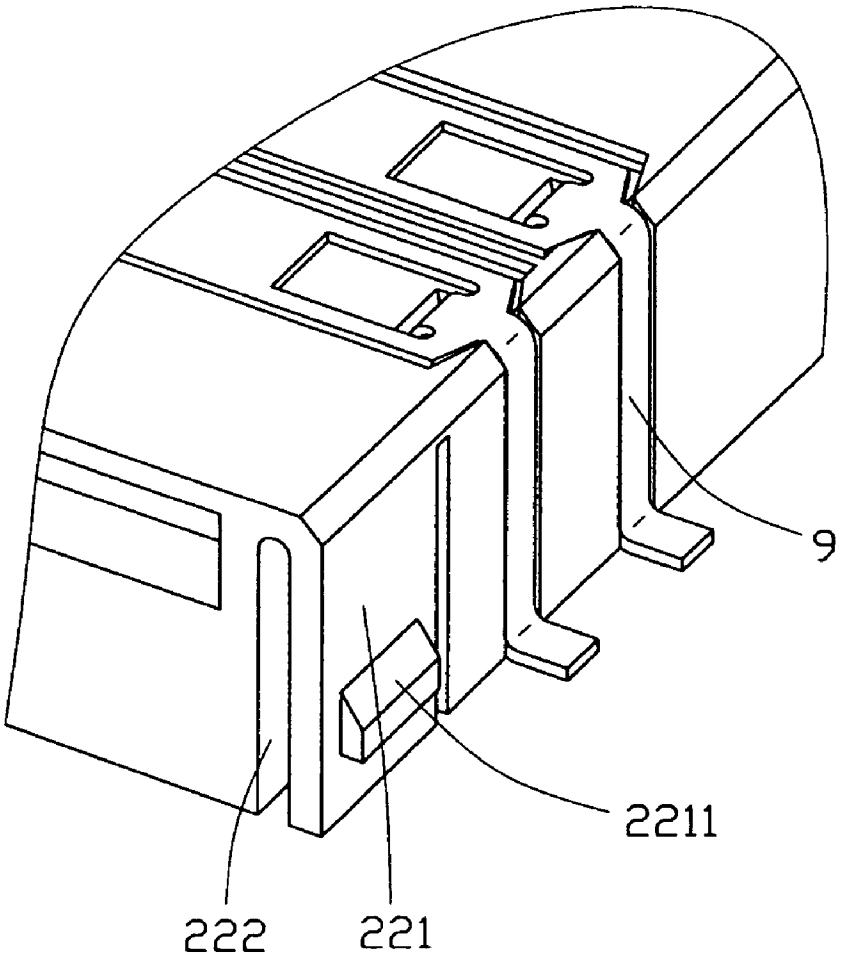
FIG. 4 is a partially enlarged view of FIG. 3, specially showing a sidewall the insulative housing.
Figure 9:
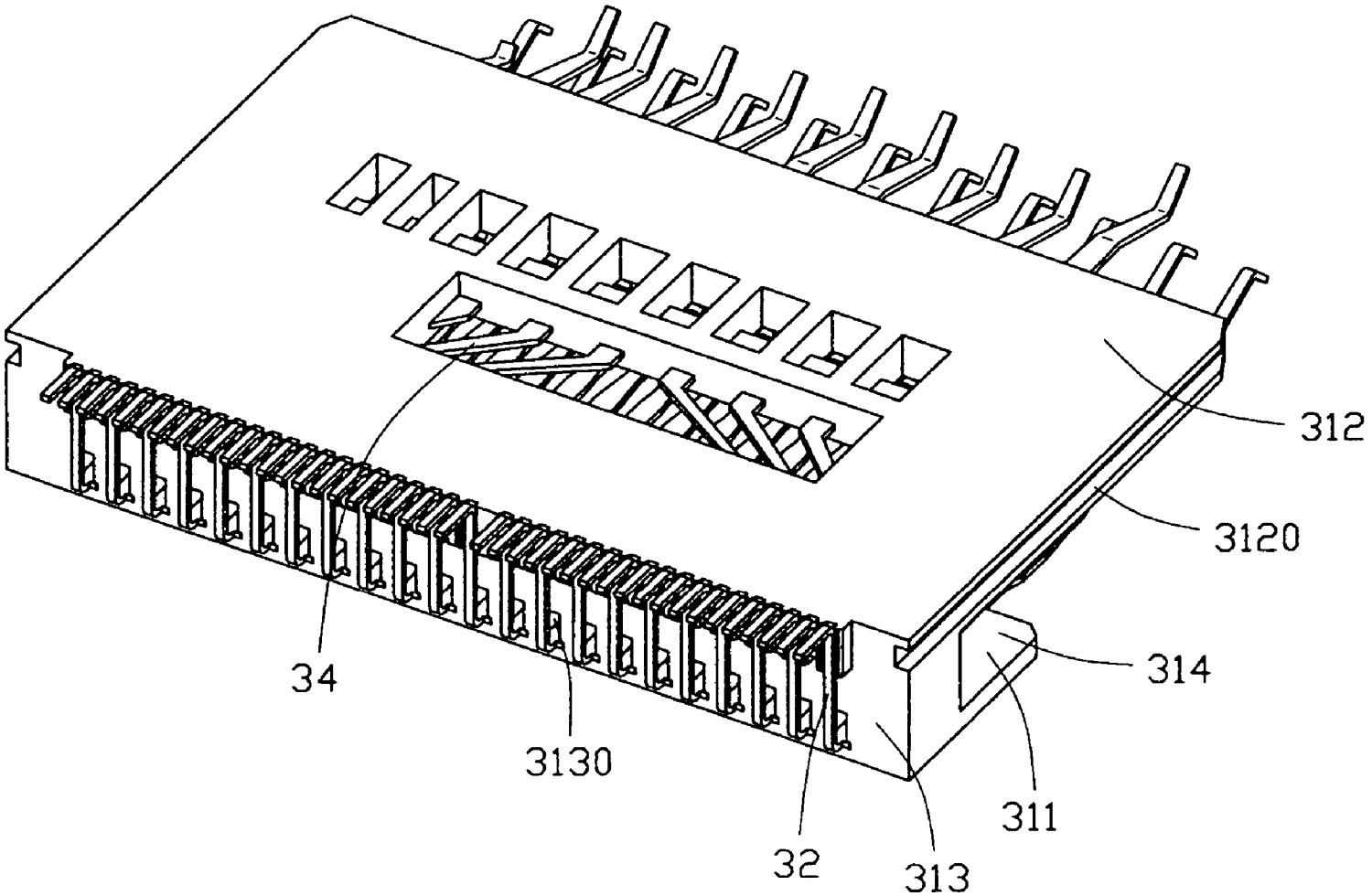
FIG. 9 is another perspective view of FIG. 8.

Referring to FIGS. 3, 5 and 6 in conjunction with FIGS. 7, 8 and 9, the terminal module 3 is installed into the housing 2. The second horizontal plate 312 of the casing 31 extends along the guiding columns 25 in a rear-to-front direction. The ribs 26 of the housing 2 are received in the guiding rabbets 3120. The body portions 321 of the SM terminals 32 are snugly received in corresponding slots 2031 of the crossrail 203 of the housing 2. Each SM, MS and SD contacting portions 323, 333, 344 of the SM, MS and SD terminals 32, 33, 34 extend into the card receiving space 24 and are appropriately curved inwardly, whereby the card can be smoothly inserted into the connector 100 to connect with corresponding terminals 32, 33, 34 without any jamming and buckling.

The positioning member 4 is attached to the housing 2 to accurately position the terminal module 3. The base portion 41 of the positioning number 4 abuts against the vertical plate 313 of the casing 31. The positioning arms 42 extend into the grooves 27 of the housing 2 and latch with the embossments 271. Horizontal portions of the SM, MS and SD mounting portions 322, 332, 343 of the SM, MS and SD 5 terminals 32, 33, 34 are held in the positioning recesses 411 of the positioning number 4.

Referring to FIGS. 3 and 5 in conjunction with FIG. 6, the XD terminals 5 are installed in corresponding passages 211 of the housing 2 in a front-to-rear direction and are exposed in the card receiving space 24 for mating with the x-D picture card. The grounding contact 6 is fixed in the grounding contact mounting recess 212 of the bottom wall 21 of the housing 2. The switch contacts 7 are retained in the switch contact mounting recesses 233 of the right sidewall 23 of the housing 2. The written contact 8 is held in the written contact mounting recess 213 of the housing 2. The written protection contacts 9 are received in the written protection contact mounting recesses 201.

Referring to FIGS. 1 and 2 in conjunction with FIG. 6, the outer shell 1 is attached to the housing 2. The top plate 11 of the outer shell 1 adheres to the upper wall 20 of the housing 2. The protrusion 202 of the upper wall 20 of the housing 2 is interferentially fitted in the aperture 111 of top plate 11 of the outer shell 1. The rear plate 13 abuts against a rear portion of the base portion 41 of the positioning member 4. The locking portions 2211, 2311 of the flaps 221, 231 of the housing 2 are interferentially fitted in the locking holes 121 of the side plates 12, thereby securely assembling the outer shell 1 to the housing 2.

Due to the above-described structure of the card connector 100, when the side plates 12 of the outer shell 1 covers the left an right sidewalls 22, 23 of the housing 2, the cantilevered flaps 221, 231 of the left and right sidewalls 22, 23 are flexible to move inwardly into the gaps 222, 232. After the locking portions 2211, 2311 of the flaps latchably engage with the locking holes 121 of the side plates 12, the flaps 221, 231 moves outwardly and come back to their normal positions. Thus, a reliable engagement between the outer shell 1 and the housing 2 is obtained.

While terms such "front", "rear", "upper", "lower", "left" and "right" have been used to help describe the invention as it is illustrated, it should be understood that the electrical connector 100 can be used in any orientation with respect to earth.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector adapted for accepting memory cards, comprising:

an insulative housing defining a card receiving space, the housing including a bottom wall and a pair of sidewalls upwardly extending from the bottom wall, each sidewall providing at least one elastic flap having an outwardly projecting locking portion, the flap being movable in sidewardly under an external force;

a plurality of terminals retained in the housing for electrically connecting with the cards; and a metal shell substantially covering the housing, the shell including a pair of side plates each defining at least one locking hole engaging with the locking portion of the at least one elastic flap of the housing.

2. The electrical card connector according to claim 1, wherein the at least one elastic flap extends downwardly from a top outer edge of the sidewall and is essentially parallel to and laterally offset from the sidewall of the housing.

3. The electrical card connector according to claim 1, wherein each sidewall of the housing defines a gap between the flap and the sidewall.

4. The electrical card connector according to claim 1, wherein the locking portion of the flap has a substantially trapeziform cross-section and includes an inclined top surface and a bottom surface perpendicular to an outer side surface of the flap.

5. The electrical card connector according to claim 1, further including a terminal module retained in the housing, the terminal module including an insulative casing and a plurality of first, second, and third conductive terminals received in the casing.

6. The electrical card connector according to claim 5, wherein each sidewall of the housing provides a rib projecting inwardly, and wherein the casing defines a pair of guiding rabbets in opposite sides thereof for engaging with corresponding ribs of the housing.

7. The electrical card connector according to claim 6, further including a positioning member attached to the housing to accurately position the terminal module.

8. The electrical card connector according to claim 7, wherein each sidewall of the housing defines a groove having an embossment, and wherein the positioning member has a pair of positioning arms latchably engaged with corresponding embossments.

9. The electrical card connector according to claim 7, wherein the positioning member defines a plurality of positioning recesses at a bottom edge thereof for receiving the first, second and third terminals.

10. The electrical card connector according to claim 1, wherein the housing includes an upper wall having an upwardly projecting protrusion, and wherein the outer shell includes a top plate providing an aperture interferentially fitted with the protrusion.

11. An electrical connector comprising:

an insulative housing defining at least one side wall;

a plurality of terminals disposed in the housing for mating with a complementary electronic part;

a metallic shell enclose said housing and defining at least one side plate covering said side wall, a slit formed in said side wall to form an elastic flap thereabouts with a locking protrusion on said flap; and an opening formed in said side plate to latchably receive said locking protrusion.

12. The electrical connector as claimed in claim 11, wherein said flap defines at an upper end a root section joined with the side wall, which performs a fulcrum to allow a lower end of the flap to be deflected laterally, and similarly the side plate defines at another upper end a root portion joined with the shell, which performs another fulcrum to allow another lower end of the side plate to be deflected laterally during vertically assembling the metallic shell to the housing.

* * * * *